US005775658A

United States Patent [19]

Englehardt

[11] Patent Number: 5,775,658

[45] Date of Patent: Jul. 7, 1998

[54] BOW HOLDER

[76] Inventor: Larry R. Englehardt, R.R. 2, Box 298, Elberfeld, Ind. 47613

[21] Appl. No.: 702,246

[22] Filed: Aug. 28, 1996

Related U.S. Application Data

[60] Provisional application No. 60/002,930, Aug. 30, 1995.

[51] Int. Cl.[6] ..... A47F 5/00

[52] U.S. Cl. ..... 248/309.1; 248/229.1; 124/23.1

[58] Field of Search ..... 248/220.1, 226.11, 248/229.1, 289.12, 231.85, 316.5, 316.1, 309.1, 229.15, 229.22; 124/1, 23.1, 86

[56] References Cited

U.S. PATENT DOCUMENTS

| | | | |
|---|---|---|---|
| 2,460,701 | 2/1949 | Marshall | 248/229.1 |
| 2,530,265 | 11/1950 | Phalan | 248/229.1 |
| 3,601,295 | 8/1971 | Lowe | 248/229.22 |
| 4,360,179 | 11/1982 | Roberts | 248/309.1 |
| 4,702,448 | 10/1987 | LoJacano et al. | 248/316.1 |
| 5,370,103 | 12/1994 | Desselly | 124/23.1 |
| 5,425,351 | 6/1995 | Kezitka | 124/86 |

*Primary Examiner*—Ramon O. Ramirez
*Assistant Examiner*—Kimberly Wood
*Attorney, Agent, or Firm*—Baker & Daniels

[57] ABSTRACT

A bow holder for holding an archery bow when the bow is not being used. The bow holder includes a base mountable to a support structure such as a hunting blind. A clamping member pivotally mounted to the base is movable between a retracted position and a clamping position, and a biaser, such as a torque spring, tends to return the clamping member to its clamping position. When the clamping member is retracted by manual operation of a lever arm, a bow engaging finger of the clamping member and a pair of bow support fingers projecting from the base define a space into which a bow can be inserted and withdrawn. When the force being applied on the lever arm is lessened, the clamping member is biased back toward the clamping position, and the bow engaging finger presses the inserted bow against the bow support fingers to thereby hold the bow within the bow holder.

4 Claims, 8 Drawing Sheets

BOW HOLDER

CROSS REFERENCE TO RELATED APPLICATION

This application claims the benefit under 35 U.S.C. § 119(e) of United States Provisional application Ser. No. 60/002,930, filed Aug. 30, 1995.

BACKGROUND OF THE INVENTION

The present invention pertains to a device for temporarily holding an archery bow when the bow is not being used, and, in particular, to a portable bow holder removably mountable to a hunting structure.

Many bow hunters hunt from structures such as blinds or stands suspended overhead within a tree. During the long stretches of time in which a hunter must patiently wait until a deer or other prey wanders within bow range, a hunter often tires of holding his or her bow, which can be fairly heavy, and therefore may want to set down the bow. However, setting a bow on the stand floor is risky in that the bow can accidentally fall to the ground, thereby requiring the hunter to descend from the stand to retrieve the fallen bow as well as possibly scaring away the prey.

Thus, it is desired to overcome this problem by providing a device which conveniently holds a bow when the bow is not being used by a hunter.

SUMMARY OF THE INVENTION

The present invention provides a bow holder which is mountable to a hunting stand and which can be used to temporarily hold or store an archery bow when it is not needed. The bow holder employs a clamping member that presses an inserted bow against support members to thereby hold the bow. The clamping member is automatically biased into engagement with an inserted bow by a torque spring or other biasing element.

In one form thereof, the present invention provides a bow holder including a base, at least one support module connected to the base and including first and second bow contacting surfaces, a clamping member movable between first and second positions and including a third bow contacting surface, and a control member manually operable to move the clamping member. The support module is structured and arranged relative to the clamping member to provide a bow insertion space between the third bow contacting surface and the first and second bow contacting surfaces when the clamping member is disposed in the first position, and movement of the clamping member from the first position toward the second position compresses the bow insertion space to thereby secure a bow inserted within the insertion space between the third bow contacting surface and the first and second bow contacting surfaces.

In another form thereof, the present invention provides an archery apparatus for holding a bow including a bow supporting means and a clamping means for pressing a bow against the bow supporting means. The clamping means is movable between a clamping position and a retracted position, and the clamping means and the bow supporting means are configured to secure an inserted bow therebetween when the clamping means is oriented in the clamping position and to define an opening therebetween into which a bow may be inserted and withdrawn when the clamping means is oriented in the retracted position. The apparatus also includes means for moving the clamping means from the clamping position to the retracted position.

One advantage of the bow holder of the present invention is that it allows a bow to be securely retained while the bow is not being held or used by a hunter.

Another advantage of the present invention is that the bow holder is easy and quiet to operate.

Still another advantage of the present invention is that a bow held within the bow holder can be quickly withdrawn, so as to be usable upon short notice.

Still another advantage of the present invention is that the bow holder is portable and removably mountable to different hunting structures, such that a single bow holder can be utilized by a hunter at different tree stands or blinds.

BRIEF DESCRIPTION OF THE DRAWINGS

The above mentioned and other advantages and objects of this invention, and the manner of attaining them, will become more apparent and the invention itself will be better understood by reference to the following description of embodiments of the invention taken in conjunction with the accompanying drawings, wherein.

Figure 1:
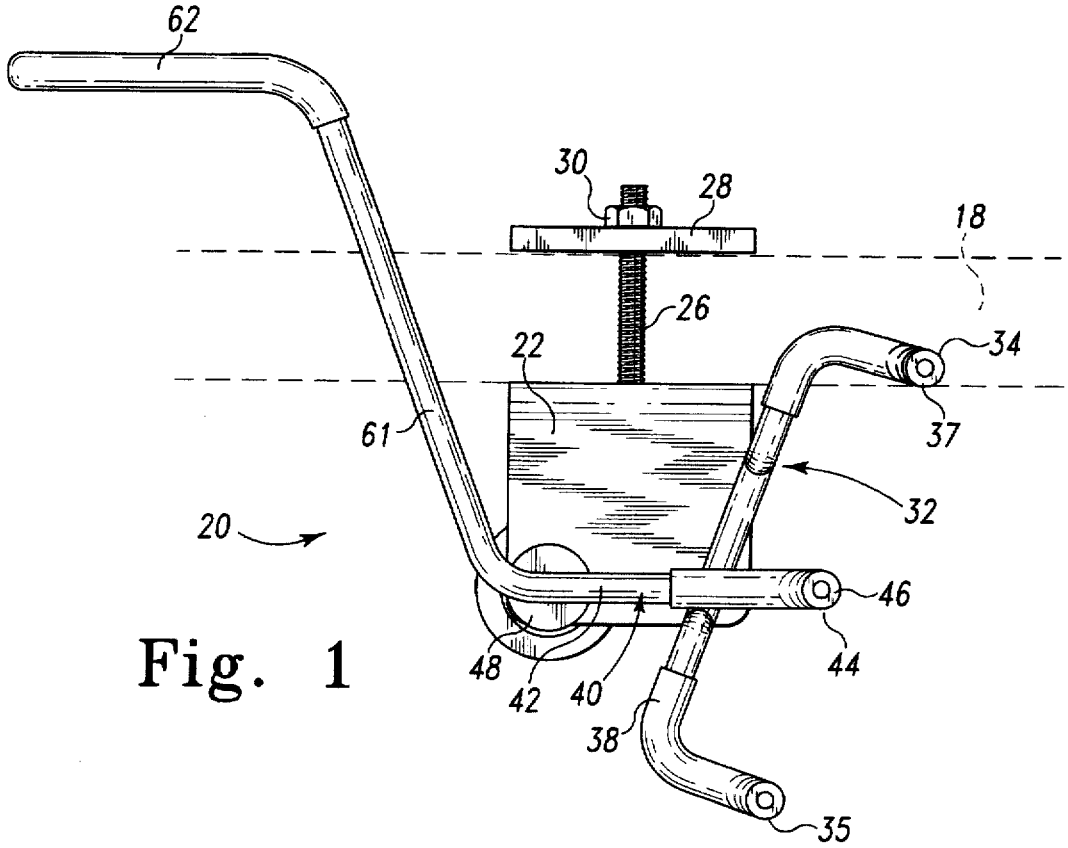
FIG. 1 is a front view of one embodiment of a bow holder of the present invention, wherein a structure to which the holder is mountable is abstractly shown in dashed lines.
Figure 2:
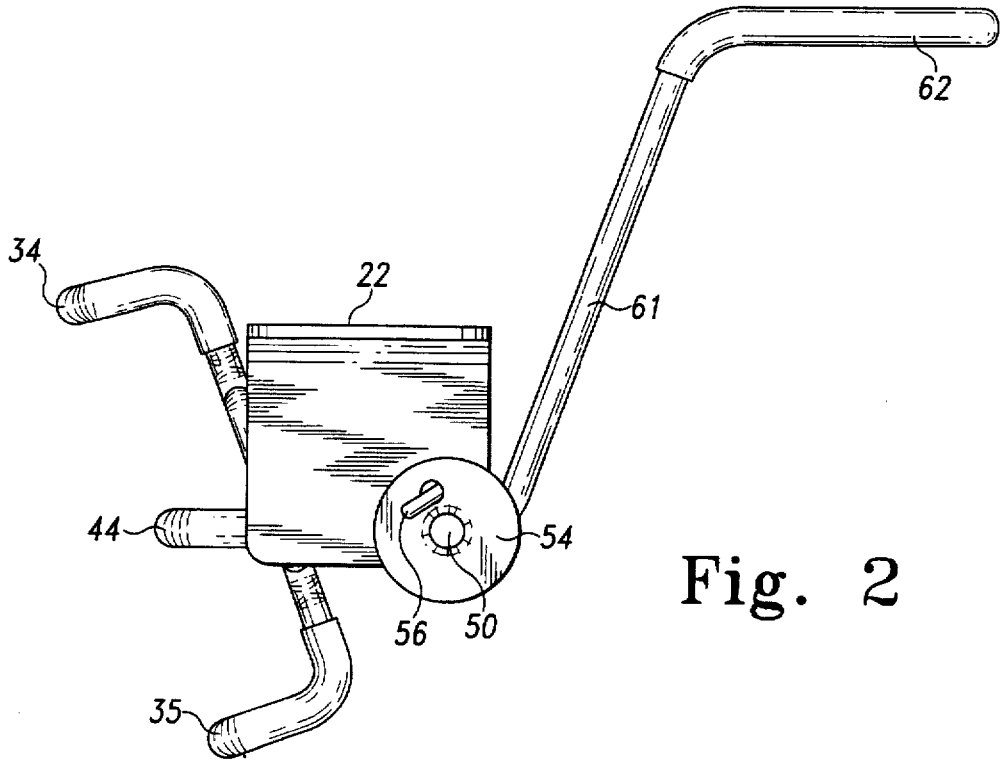
FIG. 2 is a rear view of the bow holder of FIG. 1 without the mounting plate and its associated connectors used to removably mount the bow holder to a support structure.
Figure 3:
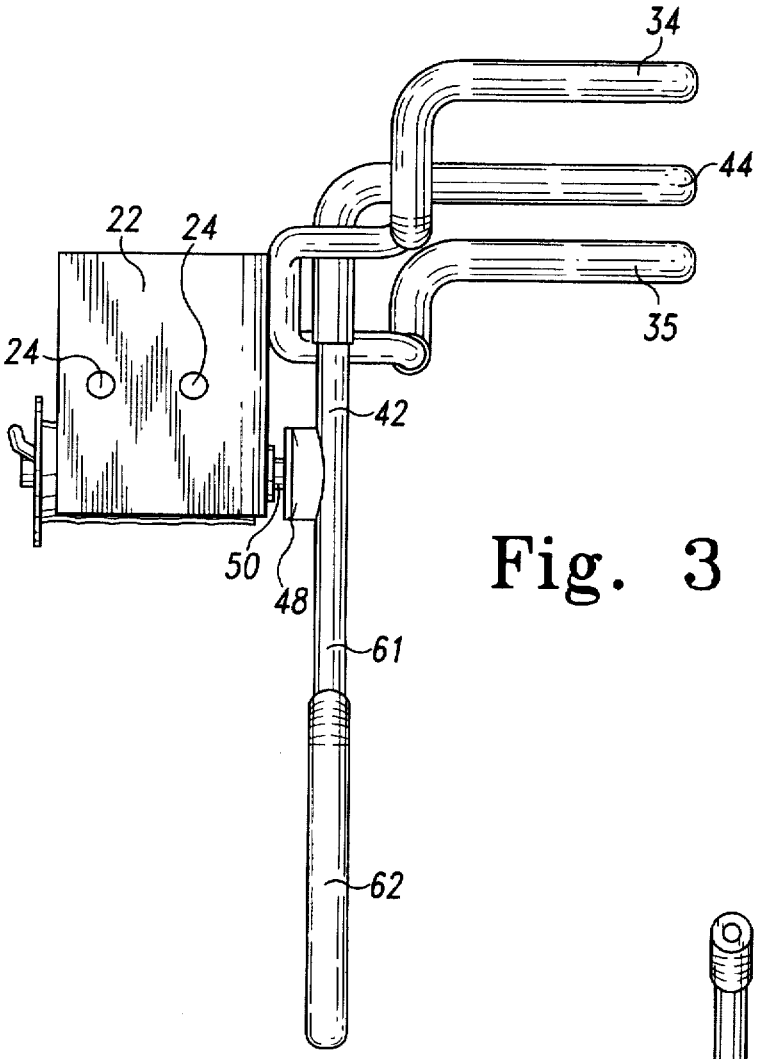
FIG. 3 is a top view of the bow holder of FIG. 2.

Corresponding reference characters indicate corresponding parts throughout the several views. Although the drawings represent multiple embodiments of the invention, the drawings are not necessarily to scale and certain features may be exaggerated or omitted in selected drawings in order to better illustrate and explain the present invention.

DESCRIPTION OF THE PREFERRED EMBODIMENTS

Referring now to FIGS. 1–8, there is shown a first embodiment of an archery bow holder configured according to the present invention. The bow holder is generally designated 20 and is shown operationally installed in FIG. 1 on the underside of a deer blind or stand abstractly shown at 18. Bow holder 20 includes a base in the form of an angled mounting bracket 22 made of steel. Other materials of construction, including aluminum or other lightweight but strong materials or composites, may be substituted for steel in the bracket and other holder components described further below. A pair of spaced apart holes 24 formed through the top, horizontal flange of mounting bracket 22 receive a pair of bolts 26 which upwardly extend through a pair of facing holes (not shown) in a square shaped mounting plate 28. Nuts 30 can be adjusted or tightened down on the threaded ends of bolts 26 to force mounting plate 28 toward bracket 22 to tightly sandwich or compress blind 18 therebetween such that holder 20 is rigidly mounted to the blind. When bow holder 20 is installed on a blind constructed with a framework including square tubing, bolts 26 flank the opposite sides of the tubing as shown in FIG. 1.

Rather than the shown nuts and bolts, different types of fasteners or couplers may alternatively be employed to connect together bracket 22 and mounting plate 28. Mounting plate 28 may be eliminated if bracket 22 is attached directly to the blind, for example with a U-shape connector. Furthermore, for both the shown blind and for alternate blind constructions, the holder base may be further modified, for example to custom fit or mount particular constructions, and therefore the base may be configured differently from the shown angle bracket design within the scope of the invention.

Welded or otherwise fixedly attached to the vertical flange of mounting bracket 22 is a rigid support member, generally designated 32, which serves as the support against which an inserted bow is pressed and held by the bow holder clamping component. Support member 32 is constructed of a hot rolled, 5/16th inch diameter steel rod and formed with multiple bends such that opposite ends 34, 35 are parallel and extend generally perpendicularly to the vertical flange of mounting bracket 22. Support member ends 34, 35 serve as prongs or fingers which engage the bow during its retainage within bow holder 20. Prongs 34, 35 are each encased within a sleeve or tubing of neoprene rubber 37, 38 which is force fit over the prong ends during manufacture. Rubber sleeves 37, 38 provide a suitable grip on an inserted bow, protect the bow held in holder 20 from damage, and further aid in deadening sound which could otherwise be generated upon the prongs being struck by a bow during bow insertion into and withdrawal from holder 20. Rather than via a force fit, sound dampening covers may be furnished on prongs 34, 35 in alternate fashions, such as by heat shrinking a plastic wrap on the prongs or by dipping the prongs into a molten material during manufacture that hardens to a firm covering.

Although shown as being part of a common support member connected to mounting bracket 22, prongs 34, 35 naturally may be part of pieces separately connected to the holder base, or may be integrally formed with the base within the scope of the invention. Furthermore, different support member shapes may be employed. For example, the bow contacting surfaces provided by prongs 34, 35 may instead be surface segments of a continuous surface, such as a custom designed, bow shaped recess formed into a solid block.

A clamping member, generally designated 40, functions to directly engage and press a bow inserted into holder 20 against prongs 34, 35 during use. Clamping member 40 includes a body section 42, formed of a 5/16th inch diameter steel rod, which bends at a 90° angle to provide a bow engaging clamping finger 44 extending parallel to support prongs 34, 35. As referenced in FIGS. 6 and 7, rigid support member 32 is formed with a notch region 33 in which clamping member 40 is free to move as it pivots from the closed position shown. Similar to prongs 34, 35, clamping finger 44 is encased in a sound dampening cover 46.

Figure 4:
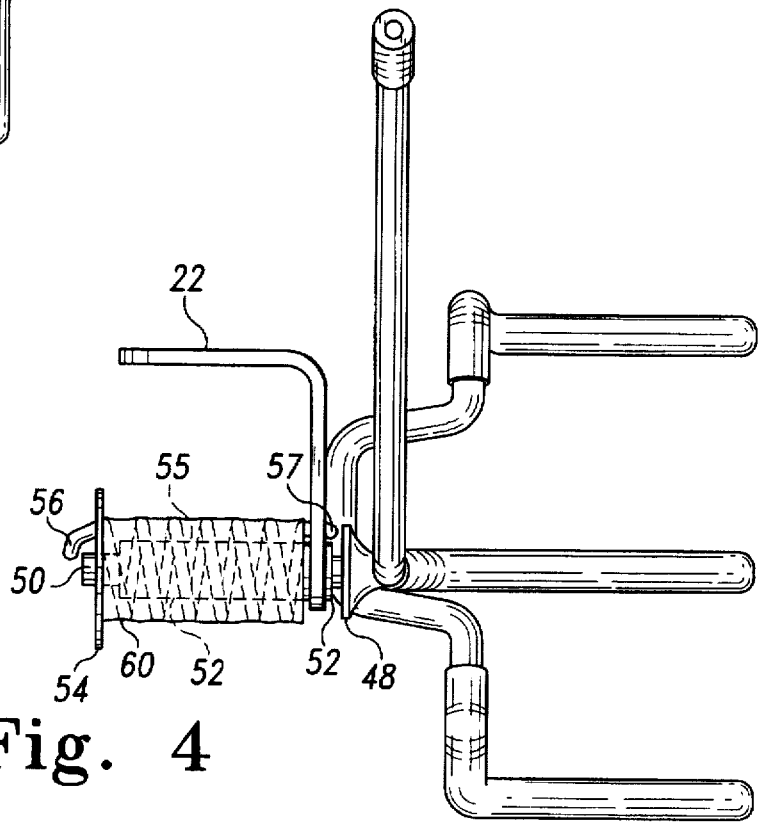
FIG. 4 is a left side view of the bow holder of FIG. 2.
Figure 5:
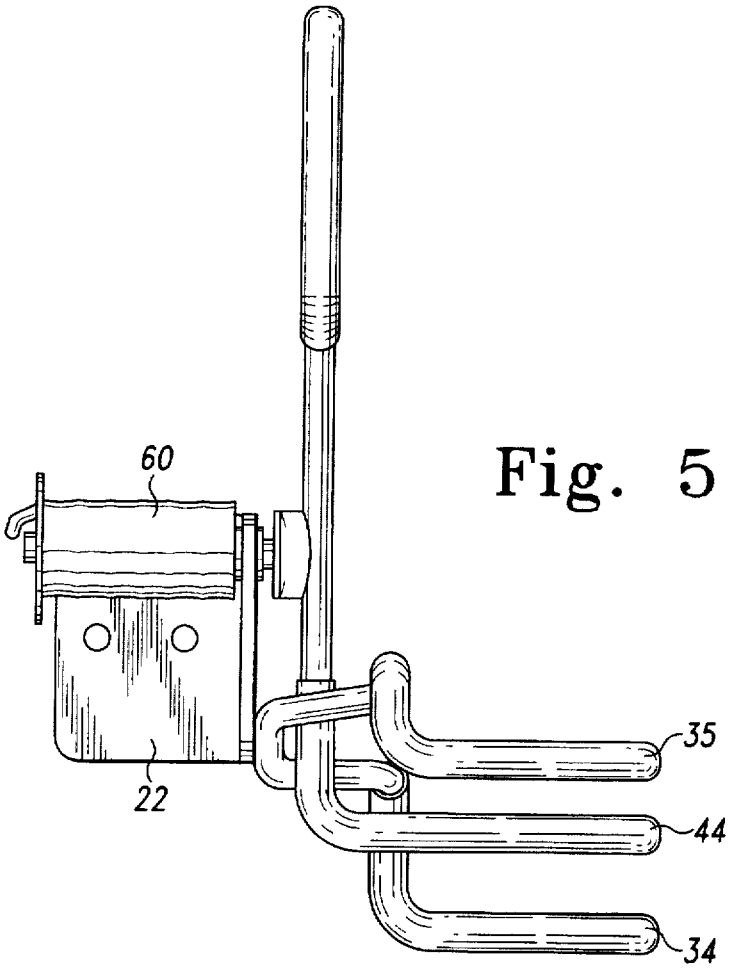
FIG. 5 is bottom view of the bow holder of FIG. 2.
Figure 6:
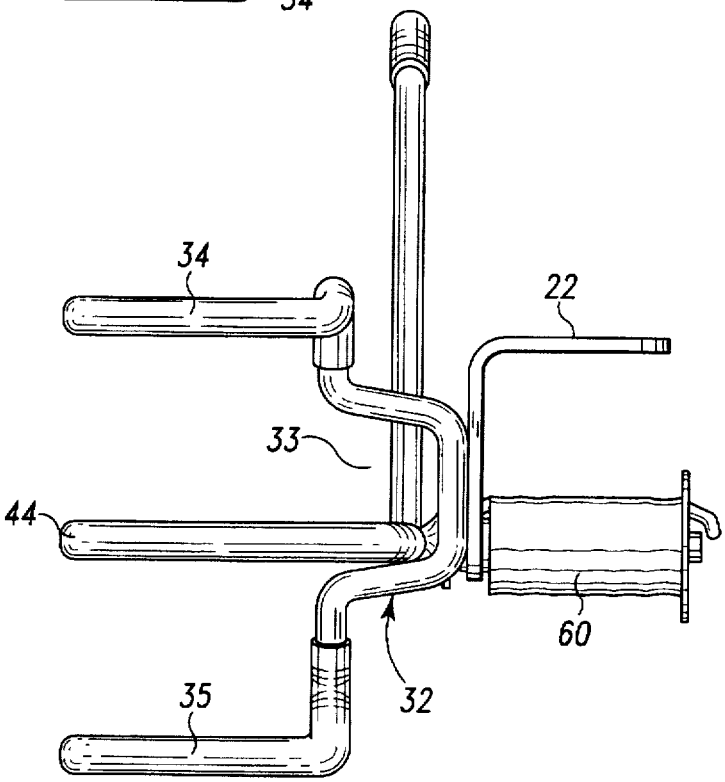
FIG. 6 is a right side view of the bow holder of FIG. 2.
Figure 7:
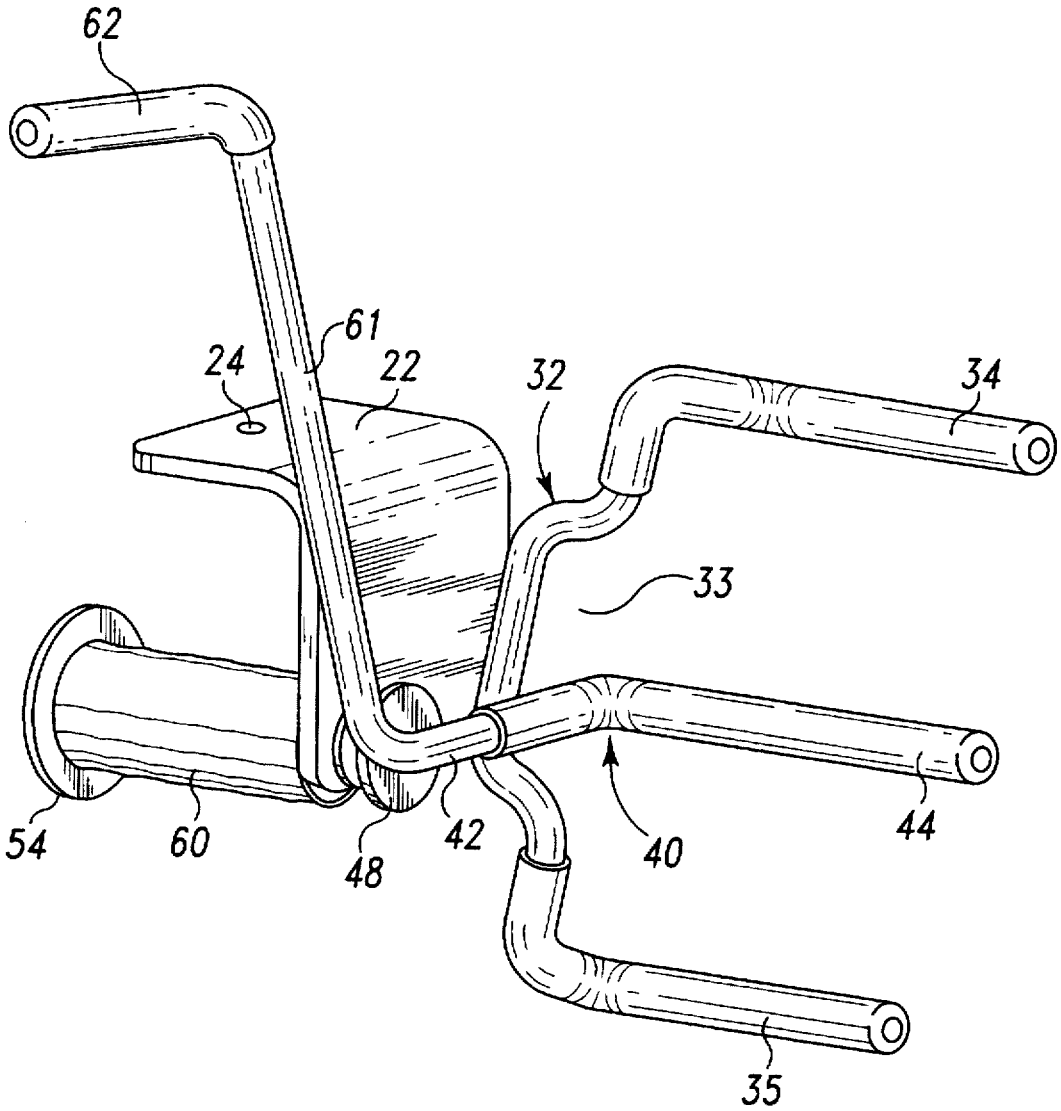
FIG. 7 is a perspective view of the bow holder of FIG. 2.
Figure 8:
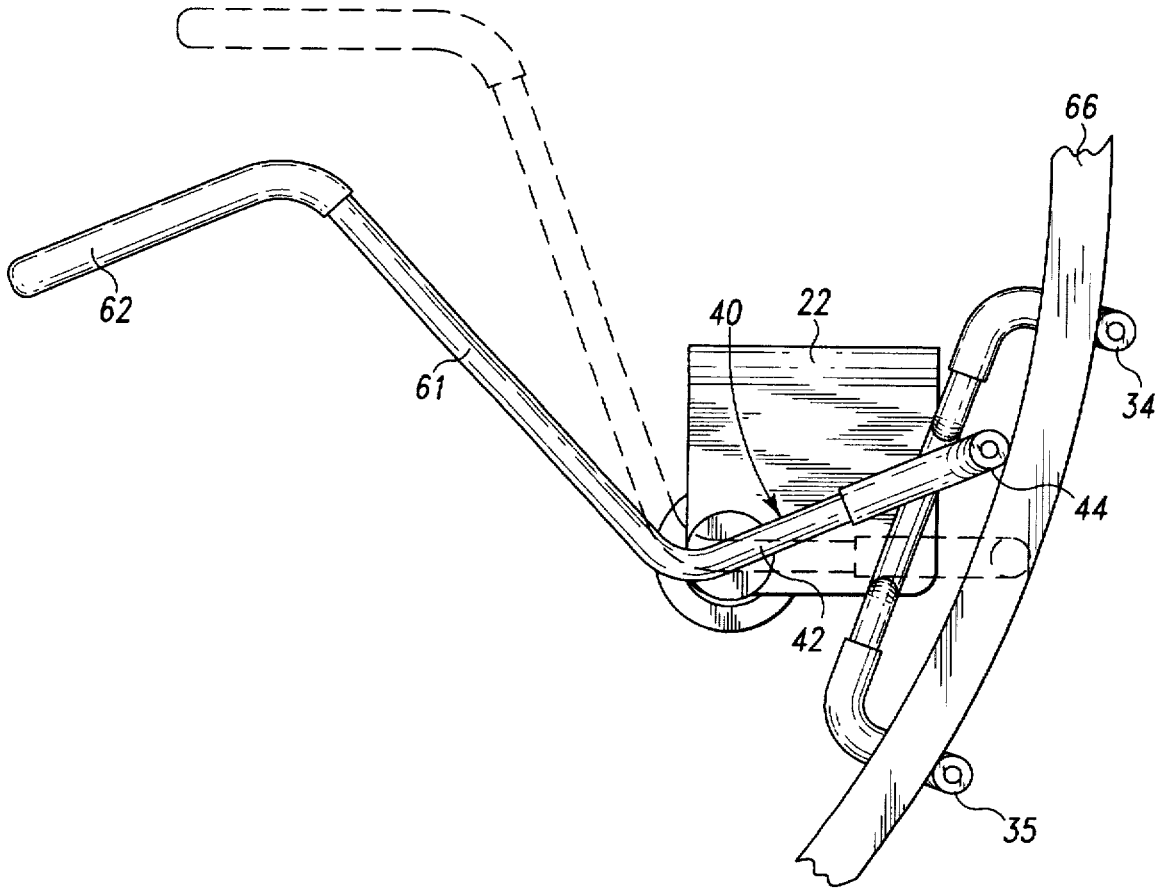
FIG. 8 is a front view of the bow holder of FIG. 2 clampably securing a partially shown bow, and wherein the clamping member and lever arm are also shown in dashed lines in the position assumed after the bow has been removed.

Fixedly attached to body section 42 is a disc-shaped plate 48, and fixedly attached to plate 48 and laterally projecting from body 42 is a pivot shaft 50 made of a 5/16th inch diameter steel rod. Welding is a preferred technique for these fixed attachments. Pivot shaft 50 axially passes through a sleeve or collar 52 welded or otherwise secured to mounting bracket 22. As shown in FIG. 4, collar 52 extends beyond the forward face of mounting bracket 22 as well as rearward of bracket 22 as indicated in dashed lines. Near the end of pivot shaft 50, a disk-shaped spring shoulder 54 is rotationally fixed with pivot shaft 50 via welding. Coaxially mounted on collar 52 is a torque spring 55 (See FIG. 4) which rotationally biases clamping member 40 toward the closed position shown in FIGS. 1–7, or in other words clockwise from the perspective of a FIG. 1 viewer. Torque spring 55 is formed of a metal strand spirally wound around collar 52 with one spring end 56 extending through a hole in spring shoulder 54 and the opposite spring end 57 extending through a hole in mounting bracket 22. A protective covering 60, such as formed by one or more wraps of an adhesive coated rubber tape, encases torque spring 55 and prevents clothing or other materials from becoming caught in the spring.

Clamping member body section 42 is integrally formed with an upwardly extending, inclined lever arm 61 which is used to control movement of clamping member 40. Rather than an integral construction, lever arm 61 naturally may be otherwise secured to clamping member 40. A grip section 62 of lever arm 61 is covered with neoprene rubber and extends in a direction generally parallel to body 42. Lever arm 61 is preferably of a sufficient length such that grip section 62 is located at a height above mounting plate 28 when bow holder 20 is installed.

The structure of bow holder 20 will be further understood in view of the following explanation of its operation. When mounted to a deer blind or other support structure but while otherwise not in use, bow holder 20 exists in the arrangement shown in FIG. 1. When a hunter wishes to temporarily hold or secure his or her bow within bow holder 20, the hunter manually engages, either via hand or via foot, grip section 62 to rotate lever arm 61 and therefore clamping member 40 counter-clockwise from the perspective of a FIG. 1 viewer. During this rotation, clamping member 40 pivots about pivot shaft 50. This pivoting occurs against the returning force provided by torque spring 55, which is twisted during this motion by the rotation of spring shoulder 54 relative to bracket 22. When clamping member 40 has been sufficiently pivoted or raised to a retracted position, the space or gap between clamping finger 44 and each of the support prongs 34, 35 is large enough to allow a hunter to initially insert (from the right from the perspective of a FIG. 3 viewer) his or her bow into holder 20.

After insertion of the bow into the created space, a hunter can slowly reduce the force applied to grip section 62. Upon this force reduction, torque spring 55 biases clamping member 40 from its retracted position toward its rest position shown in FIG. 1. As bow engaging finger 44 pivots downward, it contacts the bow and presses the bow toward and ultimately against support fingers 34, 35. At this stage, the bow (a portion of which is shown at 66) is gripped between bow engaging finger 44 and support prongs 34, 35 as shown in solid lines in FIG. 8. When the hunter subsequently releases his or her grip on bow 66, the bow will not fall from bow holder 20. In order to remove bow 66 from holder 20, clamping member 40 is pivotally retracted in the manner described above a sufficient distance to allow withdrawal of bow 66 from between the prongs.

Different bow sizes having different angles of curvature can be accommodated by bow holder 20 due to the ability of the torque spring 55 to hold the clamping member 40 at any required position. In addition, the support prongs 34, 35 and bow engaging prong 44 also can be custom arranged during manufacture to accommodate certain types of bows.

Figure 9:
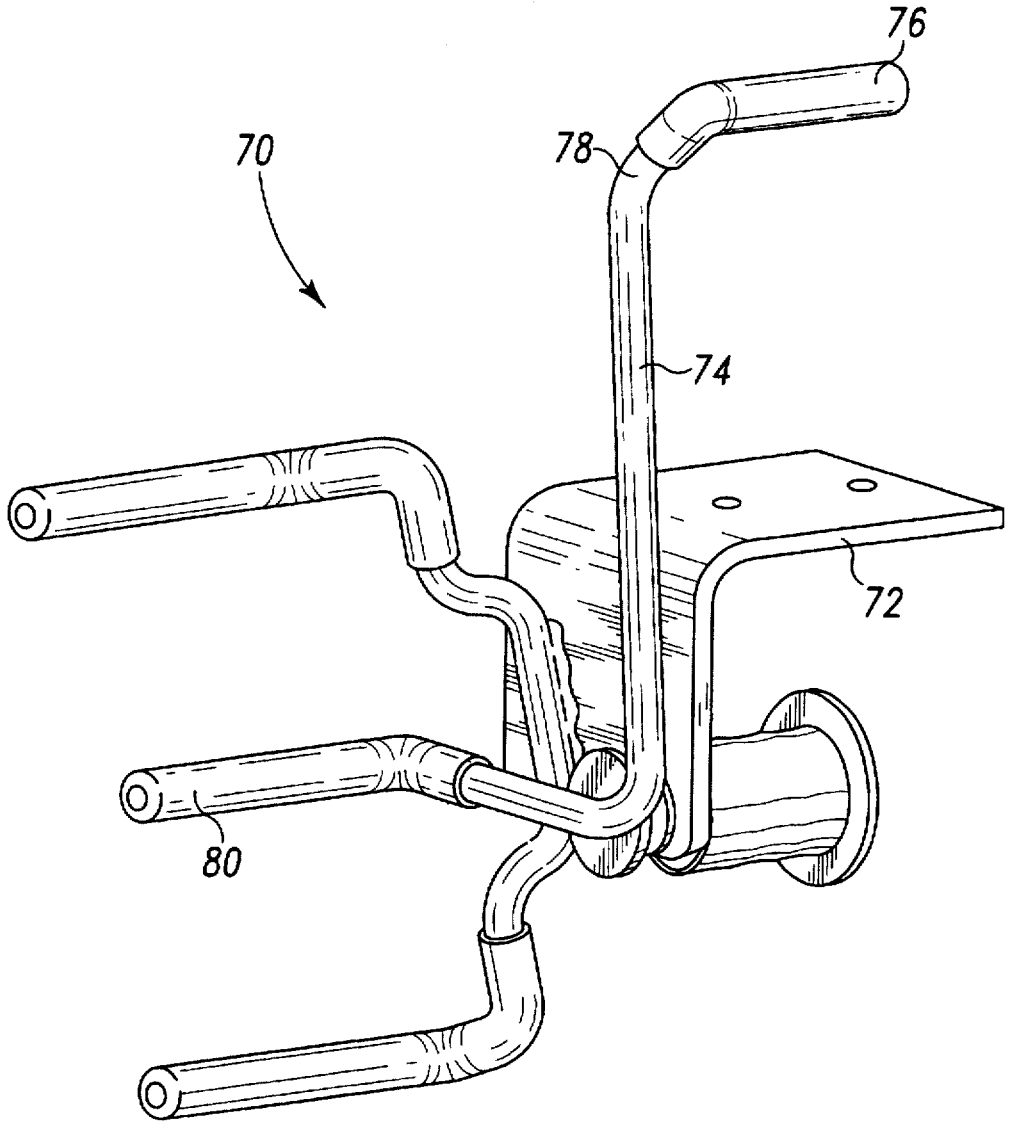
FIG. 9 is a perspective view of an alternate embodiment of a bow holder of the present invention.

Referring now to FIG. 9, there is shown a perspective view of a second embodiment of a bow holder of the present invention. This bow holder, generally designated 70, and the additional embodiments shown and described below are conceptually similar in numerous respects to the bow holder of FIGS. 1–8, and therefore further description of these alternate embodiments primarily focuses on the differences from bow holder 20. As with bow holder 20, bow holder 70 includes an angle bracket 72 which installs on the bottom surface of a support structure. Bow holder 70 is generally a mirror image of bow holder 20, and therefore a hunter may select bow holder 20 or bow holder 70 depending upon the side of a stand the bow holder is intended to be mounted. Bow holder 70 also differs from bow holder 20 in that lever arm 74 extends more vertically than lever arm 61 of the embodiment of FIG. 1, and that a rubber encased grip section 76 extends from a bend 78 in arm 74 and in an opposite direction to clamping finger 80. Grip section 76 is disposed generally above angle bracket 72. It will be appreciated that this orientation of grip section 76 more readily allows its use as a foot pedal to pivot the clamping member to a retracted position as described above with respect to the embodiment of FIGS. 1–8. Lever arm 74 is preferably sufficiently long that the blind or support structure to which bow holder 70 is mounted will not interfere with the operation or depressing of grip section 76 required to appropriately retract the clamping finger 80.

Figure 10:
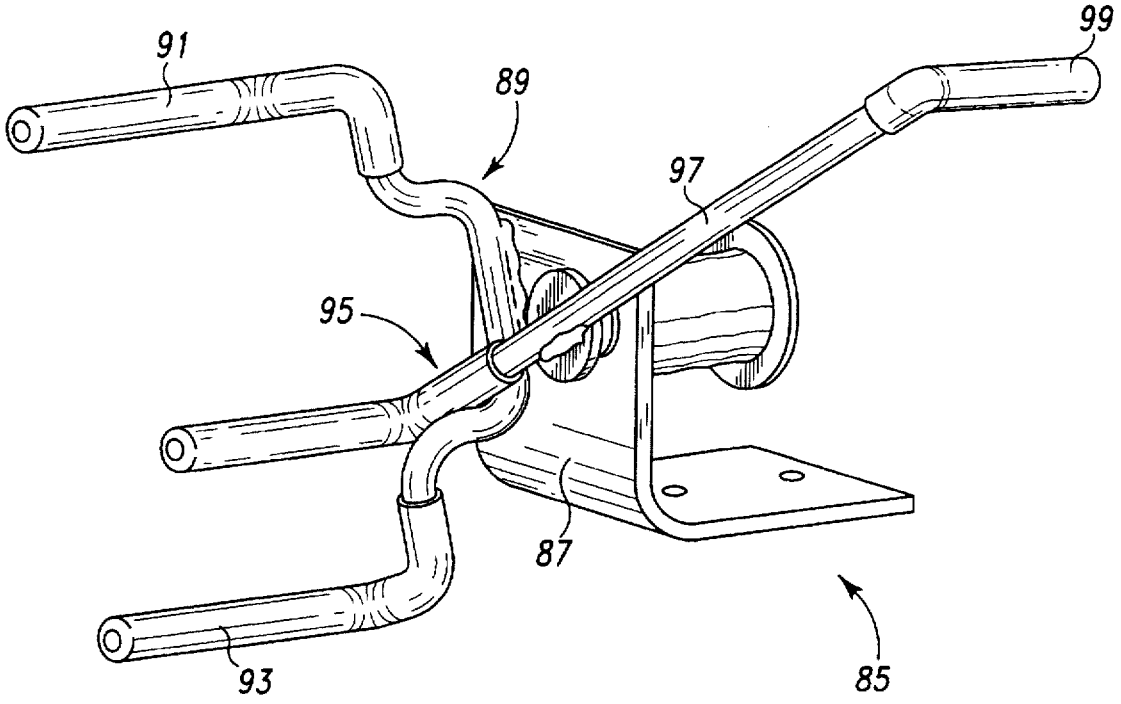
FIG. 10 is a perspective view of still another alternate embodiment of the present invention.

Referring now to the perspective view of FIG. 10, there is shown still another embodiment of a bow holder of the present invention. The bow holder, generally designated 85, is a top mount design in that its angle bracket 87 is supportably installed on the top surface of a hunting blind. A support member 89 including bow contacting support prongs 91, 93 is welded to angle bracket 87. A bow clamping member 95, operationally connected to a lever arm 97 from which extends a foot operable grip section 99 in the opposite direction of the support prongs 91, 93, is pivotally mounted to angle bracket 87 and biased to a clamping position via a torque spring as described above with respect to bow holder 20. Angle bracket 87 can be mounted to the hunting blind with fasteners or with the mounting plate and bolt connection system shown in FIG. 1.

Figure 11:
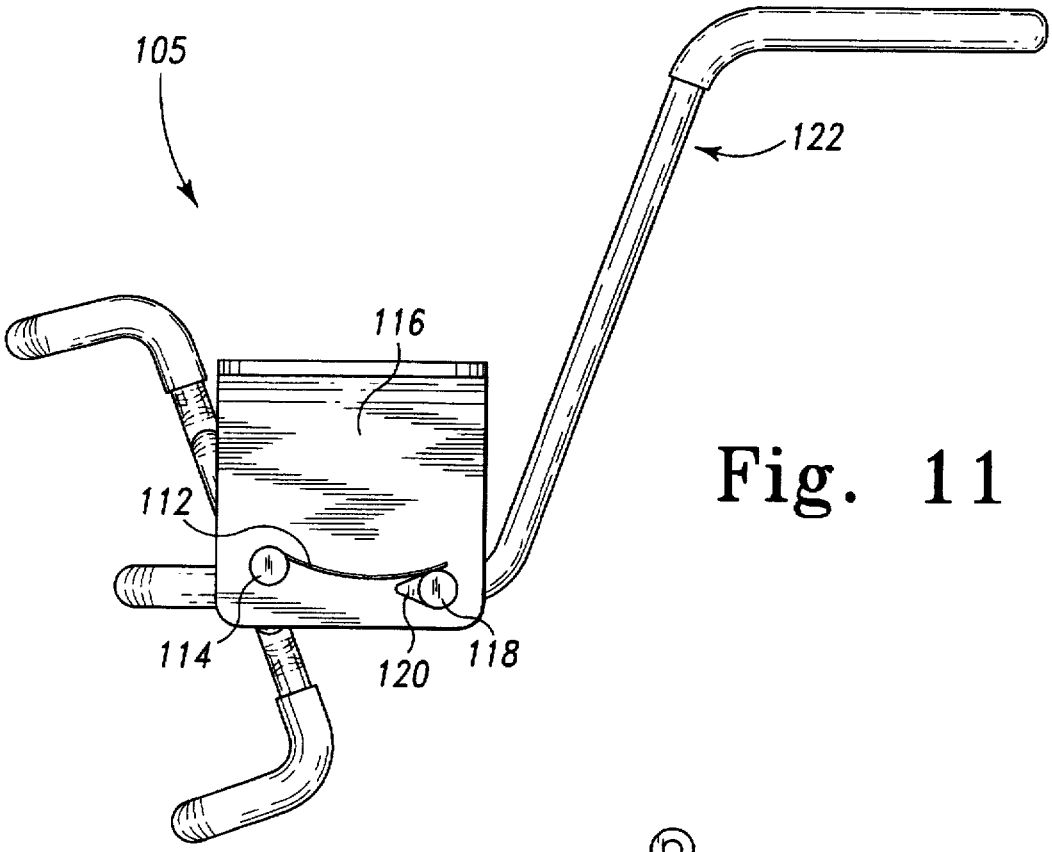
FIG. 11 is a rear view of a bow holder similar to that disclosed in FIGS. 1–8 but which utilizes an alternate biasing mechanism for the clamping member.

Referring now to FIG. 11, there is shown a rear view of another bow holder of the present invention. The bow holder, generally designated 105, eliminates the torque spring and provides for clamping member biasing via a leaf spring. Leaf spring 112 is connected to a projection 114 fixedly secured to the rear surface of vertical flange 116 of the angle bracket. The pivot shaft 118, which is connected to the clamping member and extends through a collar (not shown) mounted on the angle bracket, includes cam 120. During pivoting of the clamping member via operation of the grip/lever arm 122, cam 120 rotates into engagement with leaf spring 112. The bending of leaf spring 112 resists the rotation of pivot shaft 118 to provide the biasing of the clamping member.

Figure 12:
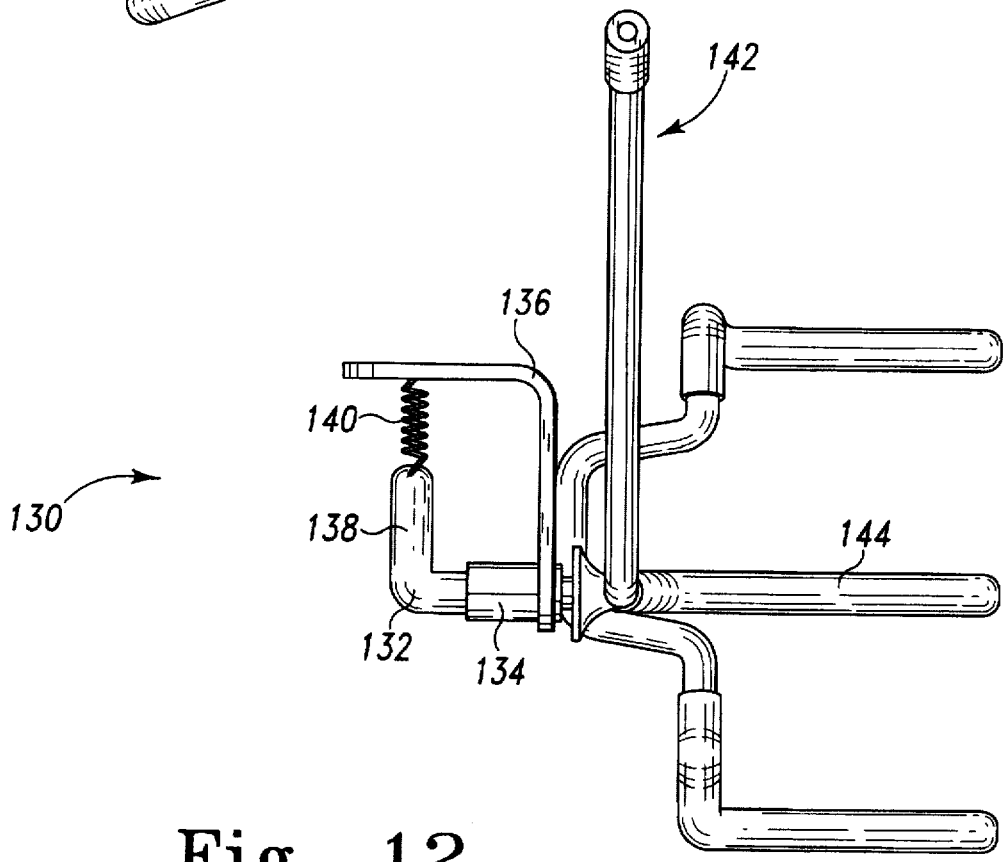
FIG. 12 is a side view of another bow holder similar to that disclosed in FIGS. 1–8 but which utilizes still another alternate biasing mechanism for the clamping member.

FIG. 12 is a side view of still another embodiment of the present invention in which an extension spring is utilized to bias the clamping member. Bow holder 130 includes an L-shaped pivot shaft 132 extending through a collar 134 attached to angle bracket 136. An upwardly extending leg portion 138 of pivot shaft 132 is connected to one end of an extension spring 140. The opposite end of extension spring 140 is secured to the horizontal flange of angle bracket 136. When the grip/lever arm 142 is rotated to move clamping finger 144 to a retracted position, the resulting rotation of pivot shaft 132 causes extension spring 140 to be extended, which generates a returning force effectively acting on the clamping finger 144. It will be appreciated that still other elements can be employed to bias the clamping finger to its clamping position. For example, rather than the leaf spring or extension spring shown in FIGS. 11 and 12, a compression spring or an elastomeric material can be utilized.

While this invention has been described and shown as having multiple designs, the present invention may be further modified within the spirit and scope of this disclosure. For example, the bow holder could be modified such that two bow contact points are provided by the clamping member and only a single bow contact point is provided by a component fixed relative to the holder base. This application is therefore intended to cover any variations, uses, or adaptations of the invention using its general principles. Further, this application is intended to cover such departures from the present disclosure as come within known or customary practice in the art to which this invention pertains.

What is claimed is:

1. A bow holder comprising:

a base;

at least one support module connected to said base and comprising a first bow contacting surface and a second bow contacting surface;

a clamping member movable between a first position and a second position, said clamping member comprising a third bow contacting surface;

wherein said at least one support module is structured and arranged relative to said clamping member to provide a bow insertion space between said third bow contacting surface and said first and second bow contacting surfaces when said clamping member is disposed in said first position, and wherein movement of said clamping member from said first position toward said second position compresses said bow insertion space to thereby secure a bow inserted within said insertion space between said third bow contacting surface and said first and second bow contacting surfaces;

a control member manually operable to move said clamping member from said second position to said first position;

wherein said clamping member is pivotally mounted to said base, and wherein said clamping member is one of integrally formed with and rigidly fixed to said control member;

a torque spring connected to said clamping member and said base for biasing said clamping member from said first position toward said second position; and a protective sleeve covering said torque spring.

2. A bow holder comprising:

a base;

at least one support module connected to said base and comprising a first bow contacting surface and a second bow contacting surface;

a clamping member movable between a first position and a second position, said clamping member comprising a third bow contacting surface;

wherein said at least one support module is structured and arranged relative to said clamping member to provide a bow insertion space between said third bow contacting surface and said first and second bow contacting surfaces when said clamping member is disposed in said first position, and wherein movement of said clamping member from said first position toward said second position compresses said bow insertion space to thereby secure a bow inserted within said insertion space between said third bow contacting surface and said first and second bow contacting surfaces;

a control member manually operable to move said clamping member from said second position to said first position;

wherein said clamping member is pivotally mounted to said base, and wherein said clamping member is one of integrally formed with and rigidly fixed to said control member;

a torque spring connected to said clamping member and said base for biasing said clamping member from said first position toward said second position; and wherein said base comprises a collar, wherein said clamping member comprises a body and a laterally projecting shaft, said shaft extending through said collar and including a shoulder, and wherein a first end of said torque spring is attached to said shaft shoulder.

3. An archery apparatus for holding a bow comprising:

means for supporting a bow:

a clamping means for pressing a bow against said bow supporting means, said clamping means movable between a clamping position and a retracted position, said clamping means and said bow supporting means configured to secure an inserted bow therebetween when said clamping means is oriented in said clamping position and to define an opening therebetween into which a bow may be inserted and withdrawn when said clamping means is oriented in said retracted position:

means for moving said clamping means from said clamping position to said retracted position:

means for biasing said clamping means from said retracted position toward said clamping position: and wherein said biasing means comprises a leaf spring and said clamping means comprises a cam arranged to cooperate with said leaf spring.

4. A bow holder comprising:

a base mountable to a support structure;

a first bow support finger and a second bow support finger, said first and second bow support fingers fixed relative to said base and extending from said base in a first direction;

a clamping member movable between a first position and a second position, said clamping member including a body and a bow engaging finger extending from said body in said first direction, said body pivotally mounted to said base;

wherein said bow engaging finger is located generally between said first and second bow support fingers, said bow engaging finger arranged to define a first space with said first and second bow support fingers when said clamping member is disposed in said first position, said first space sized and configured to allow insertion and withdrawal of a bow between said bow engaging finger and said first and second bow support fingers, wherein said bow engaging finger is arranged to press a bow inserted into said first space against said first and second bow support fingers when said clamping member moves from said first position toward said second position to thereby hold the bow between said clamping member and said first and second bow support fingers;

a control member manually operable to pivot said clamping member from said second position to said first position; and wherein said control member comprises a lever arm extending from said clamping member and a grip, wherein said grip projects from said lever arm in a direction generally opposite to said first direction.

* * * * *